US005376953A

United States Patent [19]

Voelker

[11] Patent Number: 5,376,953

[45] Date of Patent: Dec. 27, 1994

[54] THERMAL PRINTING APPARATUS WITH IMPROVED POWER SUPPLY

[75] Inventor: Martin C. Voelker, East Hampton, Conn.

[73] Assignee: Gerber Scientific Products, Inc., Manchester, Conn.

[21] Appl. No.: 54,544

[22] Filed: Apr. 27, 1993

[51] Int. Cl.[5] ..... B41J 2/32

[52] U.S. Cl. ..... 346/76 PH

[58] Field of Search ..... 346/76 PH, 134, 136; 400/120

[56] References Cited

U.S. PATENT DOCUMENTS

| | | | |
|---|---|---|---|
| 4,737,800 | 4/1988 | Caillol et al. | 346/76 PH |
| 4,973,984 | 11/1990 | Sasaki | 346/76 PH |
| 5,017,945 | 5/1991 | Sasai et al. | 346/76 PH |

FOREIGN PATENT DOCUMENTS

| | | | |
|---|---|---|---|
| 3613946 | 10/1986 | Germany | 346/76 PH |
| 0260359 | 12/1985 | Japan | 346/76 PH |
| 0251762 | 9/1992 | Japan | 346/76 PH |

OTHER PUBLICATIONS

Application Notes For Kyocera Thermal Printheads, Rev. #4 Jun. 4, 1990, pp. 1-26.

Specification KST-301-MPG8 Thermal Printhead, Kyocera Corporation, Aug. 20, 1988, pp. 1-11.

*Primary Examiner*—Benjamin R. Fuller

*Assistant Examiner*—Huan Tran

*Attorney, Agent, or Firm*—McCormick, Paulding & Huber

[57] ABSTRACT

A thermal printer has a printhead with a plurality of resistive heating elements selectively energized and de-energized to generate printed images on sheet material. In order to improve the quality of the printed image, a capacitor is provided to eliminate surges in the power supplied to the printhead. The capacitor means is mounted in close proximity to the printhead to minimize inductive impedance in the power supply system.

8 Claims, 3 Drawing Sheets

THERMAL PRINTING APPARATUS WITH IMPROVED POWER SUPPLY

BACKGROUND OF THE INVENTION

The present invention relates to a thermal printing apparatus which generates printed images in a variety of patterns on sheet material. More particularly, the apparatus has a thermal printhead with a plurality of heating elements energized by a stabilized source of power.

Printing apparatuses utilizing thermal printheads are well known, and because of their flexibility they are often utilized in printers which produce a wide variety of printed images, particularly images that are defined in stored or transmitted digital data programs. One such printing apparatus that is utilized for generating signs, designs, characters and numerous other graphic images on a strip of sheet material is disclosed in U.S. patent application 08/007,662, filed Jan. 22, 1993, which has the same assignee as the present invention. The referenced apparatus derives digital data defining the graphic image from a stored printing program and converts that data into multi-colored images.

In order to provide clear images with high resolution, the printheads are constructed with densely packed heating elements arranged in a linear array for selective energization and generation of printed images in small pixels. One such printing head has a linear array of heating elements approximately 12 inches long with elements arranged at a density of 300 per inch.

With a printhead having a large number of heating elements, a regulated power supply is needed and the power supply must have the capacity to energize all of the heating elements simultaneously or substantially simultaneously. Such energization can, however, cause significant load demands and if the image being printed has intermittent printing, that is a sequence of alternate inked and non-inked spots in the direction of printing, the regulating circuits of the power supply may not be able to respond to the load cycling between peak power and zero or low power demands of the printhead. As a consequence of load cycling and inductive impedance in the circuitry between the power supply and the printhead, the printed image may fade and intensify due to current surges that arise as transients in the circuits supplying power to the head. Such transients distort the printed image and cause it to depart from the digital data in the program that defines the image.

A number of known solutions for improving the response of the printhead include increasing the capacity of the power supply. Naturally, however, practical considerations limit the effectiveness of such a solution since the power supply is typically operating at less than 50% capacity.

Another solution which is incorporated in existing drivers for printheads is phased energization of the heating elements in the head. For example, a printhead which is 12 inches long may be divided into four sections which are triggered or enabled by four different strobe or clock signals so that the heating elements in each section are not turned on simultaneously. Instead each section is energized at intervals separated by time increments in the order of milliseconds which will not be perceptible in the printed image. Thus, sudden load demands on the power supply are distributed over a longer period of time.

In spite of the techniques employed to date in minimizing transients, problems involved with power supply to printheads still tend to arise at high printing speeds when the printed image requires substantial numbers of the heating elements in the head to be energized or de-energized simultaneously.

It is accordingly a general object of the present invention to alleviate difficulties that arise with transients in the power supply circuits for a thermal printhead in order to improve the quality and accuracy of the resulting image.

SUMMARY OF THE INVENTION

The present invention resides in a thermal printing apparatus having a printhead that contains a plurality of resistive heating elements for producing printed images. The heating elements are selectively energized and de-energized to impart thermal energy to a print medium for generating the image on sheet material.

The thermal printing apparatus includes electric power supply means having output terminals connected with each of the plurality of resistive heating elements in the printhead in order to supply electrical power at a given voltage to the elements. The elements when energized convert the electrical energy into thermal energy and through the release of the energy produce visible marks on the sheet material.

In accordance with the present inventions, capacitor means are connected across the terminals of the power supply means for stabilizing the given voltage generated by the power supply. Such stabilization prevents current surges in the presence of simultaneous or almost simultaneous energization and de-energization of all or a significant number of the resistive heating elements in the printhead. The capacitive means includes one or more capacitors that are connected to power supply means and are preferably located close to the printhead in order to reduce the effects of inductive impedance. For example, with the power supply means located in the base of the apparatus and the printhead located in the upper frame of the apparatus, the capacitors are located in the upper frame in close proximity to the printhead.

The invention is of particular utility in printing apparatus where the printhead is an elongated printhead extending transversely over a web of sheet material that is moved under the head during a printing process. In such apparatus transients or current surges from the power supply that would otherwise modulate the intensity of the image in the direction of web movement are minimized. The invention as described can be used by itself to reduce the effects of current surges, and also may be used in conjunction with other techniques to minimize the effects of load cycling and inductive impedance in the power supply circuit.

DESCRIPTION OF THE PREFERRED EMBODIMENTS

Figure 1:
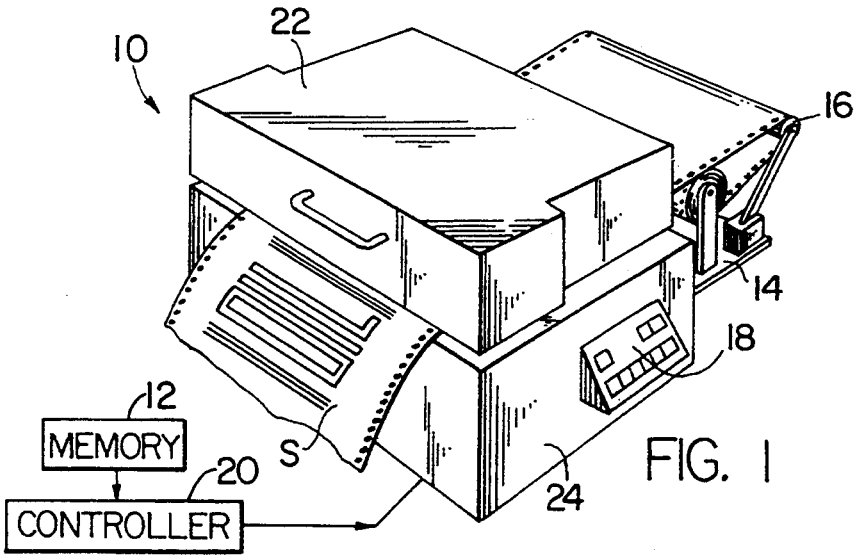
FIG. 1 is a perspective view illustrating a printing apparatus embodying the present invention.

FIG. 1 illustrates a thermal printing apparatus or printer, generally designated 10, which embodies the present invention and responds to a printing program stored in a memory 12 to generate printed images on a print medium illustrated as a strip S of sheet material. The strip is supplied in a roll which is supported on a platform 14 on the backside of the machine and is pulled over a guide roller 16 into the machine. The strip exits at the front slide of the machine with the printed images. For example, the strip S of sheet material may be a vinyl strip secured to a releasable backing material by a pressure sensitive adhesive.

After a fanciful design or image such as shown in FIG. 1 is printed on the material, the material can be placed in a cutting machine and the cut portion can then be lifted from the backing material and placed on a sign board or other object. The entire printing and cutting system is described more particularly in copending U.S. patent application Ser. No. 08/007,662, filed Jan. 22, 1993.

Figure 2:
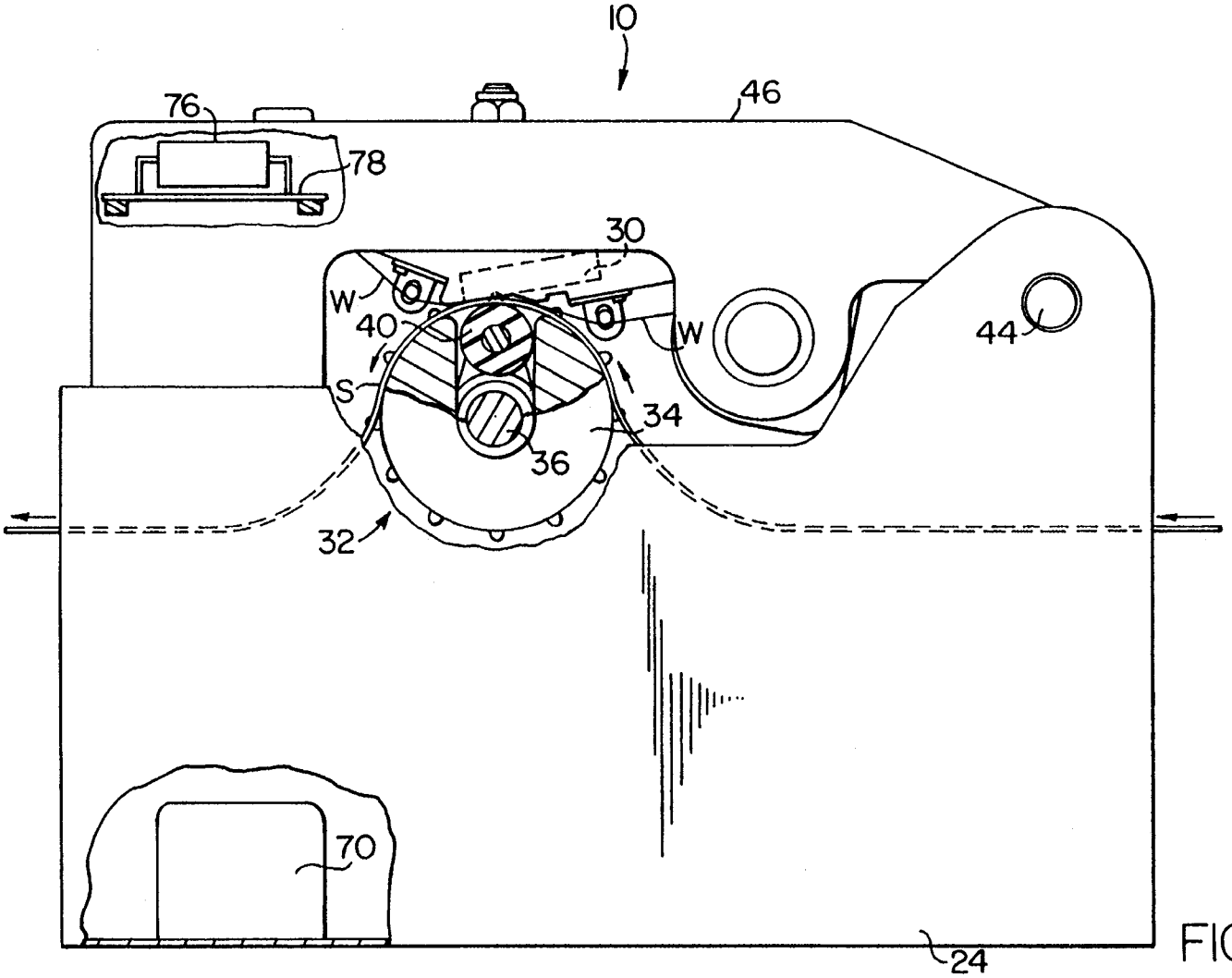
FIG. 2 is a fragmentary view of the printing apparatus in FIG. 1 and shows a thermal printhead and a drive mechanism for moving a strip of sheet material under the head during a printing operation.

The design printed on the strip S of sheet material is stored in digital form in the memory 12, and when the operator of the printer calls for a printing program to be carried out through the control panel 18, a microprocessor-based controller 20 downloads the program from memory and generates machine commands that are fed to a thermal printhead 30 and drive mechanism 32 in the printer as shown in FIG. 2 to move the strip S of sheet material through the printer as a printing operation takes place.

The printer includes a cover 22 which is pivotally mounted to the base 24 in order to open the printer and initially load the strip S of sheet material in the printer under the printhead.

FIG. 2 illustrates the interior of the printer 10 in detail with the cover 22 removed. The drive mechanism for moving the strip S of sheet material through the printer during printing as indicated by the arrows in FIG. 2 includes a pair of drive sprockets 34 (FIGS. 2 and 5) which are secured to a drive shaft 36 rotatably mounted within the base 24. A drive motor (not shown) mounted within the base is rotatably connected to the drive shaft. The sprockets 34 respectively engage a series of feed holes extending longitudinally along the lateral edges of the elongated strip of sheet material as shown in FIGS. 1 and 5.

In addition, a roller platen 40 extends between the sprockets 34 tangent to the cylindrical plane of the sprockets at their uppermost point and supports the strip S of sheet material between the sprockets. In one embodiment of the invention, the strip of sheet material is 15 inches wide and the roller platen is approximately 12 inches wide so that longitudinal edge portions of the strip overlap the platen and engage the sprockets. The platen can, if desired, be rotatably driven by the drive shaft 36. The exterior surface of the platen is preferably formed by a hard rubber sleeve that defines a friction surface engaging the strip of sheet material and supporting the material directly under the thermal printhead 30 as shown most clearly in FIG. 2.

As shown in FIG. 2, the thermal printhead 30 is supported in a support frame 46 that is pivotally connected with the base 24 at shaft 44 so that the printhead can be lifted and lowered into engagement with a strip S of sheet material passing over the roller platen 40. The printhead is typically supported resiliently from the frame 46 by a plate serving as a heat sink and mounting surface so that the printing pressure between the head and the sheet material can be controlled.

Figure 5:
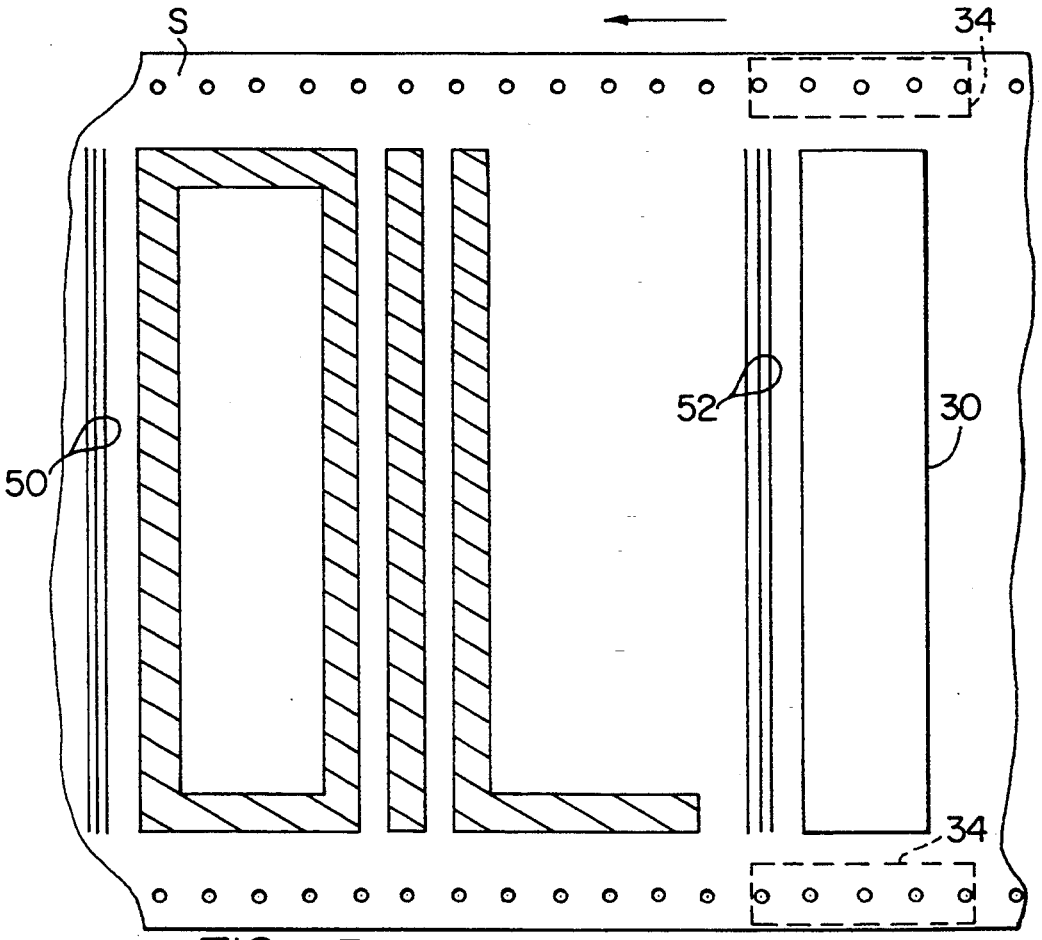
FIG. 5 is a simplified plan view of the printhead and a strip of sheet material bearing an image produced by the head.

The thermal printhead 30 extends transversely across the strip S of sheet material substantially as shown in FIG. 5 and generally has a length approximately equal to the length of the roller platen 40 underlying the strip of sheet material. The printhead is a thermal printhead having a plurality of heating elements distributed in a densely packed linear array along the head from one end to the other. For example, the elements might have a density of 300 per inch and are located to make contact with the strip of sheet material along a line or zone of contact that is defined by the curvature of the roller platen. One such head is manufactured by Kyocera Industrial Ceramics, Inc. of Kyoto, Japan.

In order to print images on a strip S of sheet material which is not itself thermally responsive, such as a strip of vinyl, a donor web W bearing a thermally releasable printing ink is fed between the printhead 30 and the strip S as shown in FIG. 2. The web W is supported on supply and take-up spools (not shown) mounted within the support frame 46 and advances synchronously with the strip S of sheet material under the head during a printing operation due to the frictional engagement of the web and the strip. As the web and strip pass under the thermal printhead, the heating elements of the printhead are selectively energized to release the printing ink from the web onto the strip in a print pattern that is defined in a print program within the memory 12 of FIG. 1.

Certain printed images contain ink patterns which require all or a substantial number of the printing elements in the printhead 30 to be energized or de-energized simultaneously or substantially simultaneously. For example, the printed image in FIG. 5 contains a series of decorative bars 50 and 52 which extend transversely of the strip S parallel to the printhead 30. In addition, the elements of the letters "OIL" also extend transversely of the strip and parallel to the web. The bars and the letters have a length approximately equal to that of the printhead and, therefore, all or substantially all of the printing elements of the head must be energized and de-energized simultaneously as the strip translates in the direction indicated by the arrows perpendicular to the bars. The rapid energization and de-energization of all of the elements can introduce transients in the power supplied to the elements, and as a consequence the intensity or tone of the elements can be affected by current surges arising from the load cycling. The intensity variations are generally due to the fact that the regulating circuitry of the power supply is not able to respond instantaneously to the sudden changes in power as required by the digital data that is fed to the printhead by the printing program.

Figure 3:
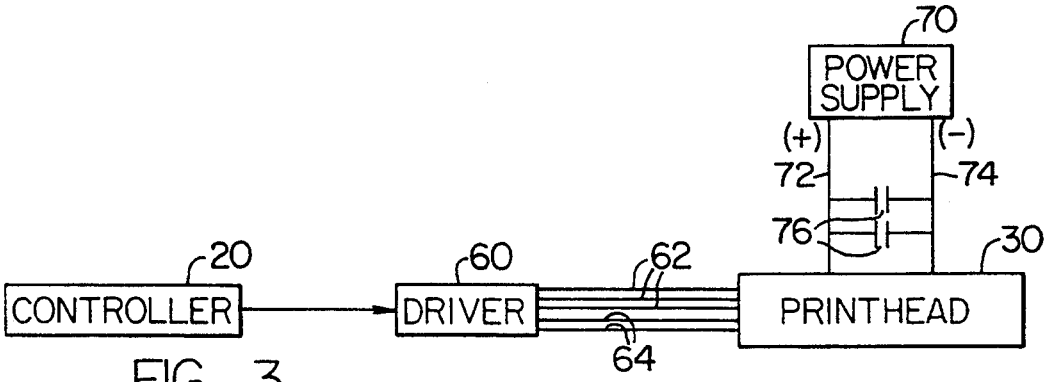
FIG. 3 is a block diagram illustrating the control and power circuits for the printhead in FIG. 1.

FIG. 3 illustrates a block diagram of the principal control and power components that operate the printhead 30. The controller 20 supplies digital data defining the printed image to a solid state driver 60. The driver has a series of data output lines 62 which feed digital data defining the desired excitation state of the heating elements in the printhead at each step of the printing operation. Data pulses are supplied serially over the lines 62 and are distributed to the heating elements within the various sections of the printhead. In addition, the driver circuit 60 may include a number of strobe lines which deliver strobe pulses for energizing the heating elements in different sections of the printhead at slightly different times in order to shift slightly the power demands of each section. For example, with the two lines as shown, the strobe pulses on one of the lines 64 may energize the heating elements having positive data pulses in the one half of the printhead, and the strobe pulses on the other of the lines 64 would energize the elements having positive data pulses in the other half of the printhead. The strobe pulses on the two lines are separated in time by a matter of milliseconds and therefore one slight shift of print pulses is not noticeable in the image.

An electrical power supply 70 for the printhead is preferably a regulated DC power supply having a positive output terminal 72 and a negative or ground terminal 74. These terminals are connected to the terminals of the printhead which energize the resistive heating elements. Thus the power supply provides all of the electrical power that is converted into thermal energy to release the thermally sensitive ink on the web W and deposit that ink onto the strip S of sheet material. The power supply 70 may provide other power for operating the head as well. Ideally the DC voltage appearing at the terminals 72 and 74 should remain constant so that the resistive heating elements in the printhead provide images consistant with the printing program.

In accordance with the present invention, one or more capacitors 76 are connected across the terminals of the power supply 70 in order to maintain the desired output voltage and to suppress current surges that arise from the energization and de-energization of the heating elements in the printhead. Thus, the capacitors stabilize the output voltage and insure that the image generated by the printhead has a tone and quality corresponding to that intended by the stored printing program.

As shown in FIG. 2, the capacitors 76 are mounted on a circuit board 78 within the support frame 48 of the printer. Such a mounting locates the capacitors close to the printhead 30 and thus minimizes inductive impedance of the circuitry interconnecting the power supply and the printhead. The power supply 70 is normally mounted in the base 24 of the printer since it is a generally bulky and heavy item. In addition, the power supply generally has multiple outputs for energizing other electrical components such as the driver 60 and the controller 20 which are defined by components on circuit boards mounted in the base 24. Hence, in the printer 10 as illustrated in FIG. 2 long conductors lead from the power supply 70 around the pivotal shaft 44 and up to the printhead 30 in a rather circuitous path. If the capacitors 76 are mounted in the base 24, substantial inductive impedance with surrounding structure could significantly interfere with the otherwise clean voltage that should be delivered to the printhead 30. Thus, the mounting of the capacitors 76 in the support frame 46 compensates for such impedance.

Figure 4:
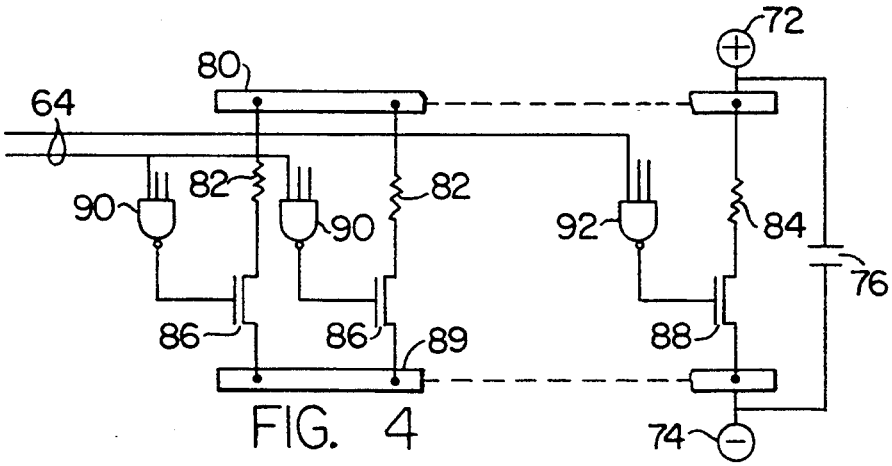
FIG. 4 is an abbreviated electrical schematic showing a number of the replicated components in the driver circuit and the thermal printhead.

FIG. 4 is an electrical schematic showing the circuitry of the printhead in abbreviated form as well as the electrical connection of the capacitors 76. The positive terminal 72 of the power supply 70 is connected with a positive power bus 80 extending along substantially the entire length of the printhead. The individual resistive heating elements 82 (only two shown) in one half of the printhead, and the individual heating elements 84 (only one shown) in the other half of the head are each connected at one end with the power bus 80. The other ends of the heating elements 82 are connected with the ground bus 89 through thermistor switches or FET's 86 which control the energization and de-energization of the heating elements 82. Similarly, the ends of the heating elements 84 opposite the power bus 80 are connected with the ground bus 89 through thermistor switches or FET's 88 for the same purpose. The capacitors 76 are effectively connected across the power buses 80,89 in parallel with the heating elements 82,84. Thus the capacitors tend to maintain the voltage across the elements and suppress current surges caused by the operation of the elements.

The control gates of the FET's 86 are connected with one of the strobe lines 84 through NAND gates 90. The gates of the other FET's 88 are connected with the other strobe line 64 through NAND gates 92. In this manner the heating elements 82 are strobed at a time slightly different from the elements 84 to spread the power demands on the supply 70 over a brief interval of time.

Individual control of the elements in accordance with the digital data of the printing program is established through the data lines 62 in FIG. 3 which are connected to one of the other inputs of the NAND gates 90,92.

While the present invention has been described in several embodiments, it should be understood that numerous modifications and substitutions can be made without departing from the spirit of the invention. For example, the controls for energizing the various heating elements of the printhead may vary widely as long as they permit discrete control of the elements and accommodate variations in the printing program. The exact structure of the thermal printer can vary widely along with the drive mechanism from moving the material relative to the printhead. The sheet material on which the printhead operates may be thermally sensitive heating material, in which case the necessity of having a donor web for transferring ink to the sheet material is unnecessary. The number and value of the capacitors connected across the terminals of the power supply should be set to accommodate the power demands and the characteristics of the power supply system which energizes the printhead. Furthermore, the location of the capacitors between the power supply and the thermal printhead should be selected to minimize the effect of inductive impedance in the supply system. Accordingly, the present invention has been described in several preferred embodiments by way of illustration rather than limitation.

I claim:

1. A thermal printing apparatus comprising:

a base for supporting a sheet material during generation of a printed image;

a support frame movably mounted on the base;

a thermal printhead mounted in the support frame and having a plurality of resistive heating elements selectively energized and de-energized to impart thermal energy to a print medium for the generation of a printed image on a sheet material;

electrical power supply means mounted in the base and having output terminals connected with each of the plurality of resistive heating elements in the printhead for supplying electrical power at a given voltage for conversion thermal energy by the plurality of heating elements; and capacitive means mounted in the support frame and connected across the terminals of the power supply means for stabilizing the given voltage and preventing current surges of substantially simultaneous energization or de-energization when all or a significant number of the resistive heating elements in the printhead are simultaneously energized or de-energized.

2. A thermal printing apparatus as defined in claim 1 wherein the support frame is pivotally mounted to the base.

3. A thermal printing apparatus as defined in claim 1 wherein drive means is mounted in the base for moving the sheet material relative to the printhead mounted in the support frame.

4. A thermal printing apparatus as defined in claim 1 wherein the electrical power supply means includes a D.C. power supply having two output terminals; and the capacitive means includes at least one capacitor connected across the two terminals of the D.C. power supply.

5. A thermal printing apparatus as defined in claim 1 wherein:

the thermal printhead has the plurality of heating elements distributed in a linear array; and driver circuit means is connected with the plurality of heating elements for controlling energization of the elements in the array and includes strobe means inhibiting simultaneous energization of all the heating elements in the array.

6. A thermal printing apparatus as defined in claim 5 wherein the strobe means has at least two outputs connected respectively with the heating elements in two sections of the linear array for enabling elements of each of the sections at slightly different times.

7. A thermal printing apparatus for printing images on strips of sheet material comprising:

a base;

a support frame mounted on the base;

a thermal printhead mounted in the support frame and having a plurality of heating elements distributed in a linear array for selective energization to create printed images on sheet material;

drive means mounted in the base for engaging and moving a strip of sheet material relative to the printhead in a direction transverse to the array of heating elements;

power supply means mounted in the base for supplying current to the heating elements and having output terminals electrically connected with the plurality of heating elements in the printhead in the support frame; and capacitive means also mounted in the support frame with the printhead and electrically connected with the heating elements for suppressing surges in the current supplied to the elements by the power supply means.

8. A thermal printing apparatus for printing apparatus as defined in claim 7 wherein the support frame is mounted on the base for movement between open and closed positions; and the drive means is mounted in the base for engaging and moving a strip of sheet material relative to the printhead in a direction transverse to the array of heating elements with the support frame in the closed position.

* * * * *

UNITED STATES PATENT AND TRADEMARK OFFICE

CERTIFICATE OF CORRECTION

PATENT NO. : 5,376,953

DATED : December 27, 1994

INVENTOR(S) : Martin C. Voelker

It is certified that error appears in the above-identified patent and that said Letters Patent is hereby corrected as shown below:

Column 6, line 67, after the word "conversion" insert --into the--;

Column 7, lines 4-5, delete "of substantially simultaneous energization or de-energization".

Signed and Sealed this

Twenty-eight Day of February, 1995

*Attest:*

Bruce Lehman

BRUCE LEHMAN

*Attesting Officer*

*Commissioner of Patents and Trademarks*